US008919567B2

(12) United States Patent
Tieu et al.

(10) Patent No.: US 8,919,567 B2
(45) Date of Patent: Dec. 30, 2014

(54) SCREEN CLOTH FOR VIBRATING OR STATIONARY SCREENS

(75) Inventors: John Tieu, Fort McMurray (CA); Gilbert Rumbolt, Fort McMurray (CA); Daniel MacNeil, Fort McMurray (CA)

(73) Assignee: Syncrude Canada Ltd., Fort McMurray (CA), In trust for the owners of the Syncrude Project as such owners exist now and in the future ( * ) Notice: Subject to any disclaimer, the term of this patent is extended or adjusted under 35 U.S.C. 154(b) by 422 days.

(21) Appl. No.: 13/272,100

(22) Filed: Oct. 12, 2011

(65) Prior Publication Data

US 2013/0092608 A1 Apr. 18, 2013

(51) Int. Cl.
*B07B 1/49* (2006.01)
*B07B 1/46* (2006.01)

(52) U.S. Cl.
CPC ..... *B07B 1/469* (2013.01); *B07B 1/4609* (2013.01)
USPC ..... 209/392; 209/393; 209/397; 209/400; 209/401

(58) Field of Classification Search
USPC ..... 209/392, 393, 397, 400, 401
See application file for complete search history.

(56) References Cited

U.S. PATENT DOCUMENTS

| | | | | |
|---|---|---|---|---|
| 3,640,760 | A * | 2/1972 | Nichols, Jr. | 428/136 |
| 3,943,054 | A * | 3/1976 | Simonson | 209/392 |
| 4,313,992 | A * | 2/1982 | Spiewok | 428/136 |
| 4,832,834 | A * | 5/1989 | Baird, Jr. | 209/397 |
| 8,281,933 | B2 * | 10/2012 | Gronvall et al. | 209/393 |
| 2009/0173595 | A1 * | 7/2009 | Burstrom | 193/25 E |

FOREIGN PATENT DOCUMENTS

| | | |
|---|---|---|
| CA | 2524540 | 5/2006 |
| CA | 2645317 | 5/2010 |
| CA | 2689771 | 7/2010 |

* cited by examiner

*Primary Examiner* — Terrell Matthews
(74) *Attorney, Agent, or Firm* — Bennett Jones LLP

(57) ABSTRACT

An impact screen cloth for use in a screening device for screening out oversize objects in a material flowing in a direction is provided, comprising a metal plate having a perimeter and comprising a plurality of openings therethrough and forming a grid having longitudinal ligaments substantially parallel to the direction of the material flow and transverse ligaments substantially perpendicular to the direction of the material flow; and a number of longitudinal wear bars positioned on an equal number of longitudinal ligaments to cover a substantial portion of the number of longitudinal ligaments without substantially interfering with the openings.

27 Claims, 6 Drawing Sheets

SCREEN CLOTH FOR VIBRATING OR STATIONARY SCREENS

The present invention relates generally to stationary or vibrating screening devices. In particular, an impact screen cloth useful in stationary and/or vibrating screens for screening oversize objects in a material is provided comprising a plurality of longitudinal wear bars positioned on the impact screen cloth in the direction of travel of the material to be screened.

BACKGROUND OF THE INVENTION

Vibrating and/or stationary screens are used in coal dressing, metallurgy, mine, power station, and the like. They are primarily used for the classification of bulk materials such as coal, minerals, coke, etc. Vibrating and/or stationary screens are also used in the oil sand industry, in particular, in oil sand slurry preparation plants.

Oil sand, such as is mined in the Fort McMurray region of Alberta, generally comprises water-wet sand grains held together by a matrix of viscous bitumen. It lends itself to liberation of the sand grains from the bitumen by mixing or slurrying the oil sand in water, allowing the bitumen to move to the aqueous phase.

As-mined or pre-crushed oil sand is generally mixed with warm or hot water to yield an oil sand slurry. The slurry is then conditioned in a hydrotransport pipeline and subsequently introduced into a large, open-topped, conical-bottomed, cylindrical vessel commonly termed a primary separation vessel (PSV) where the more buoyant aerated bitumen rises to the surface and forms a bitumen froth layer.

It may be desirable to remove the larger aggregates present in oil sand slurry prior to pipelining in order to avoid blockage or damage of downstream equipment, e.g., pump component wear. Thus, vibrating screens may be used at various points during slurry preparation to reject larger lumps of oil sand, rocks and other aggregates, which are large enough to block or damage downstream equipment, prior to pipeline conditioning. Screens may also be used to further screen oil sand tailings slurry prior to treating/disposing same.

However, oil sand slurry is extremely heavy and abrasive due to the large amount of sand, gravel and crushed rock contained therein. Further, primary vibrating screens are generally vibrating with an acceleration of approximately 4-5 g, so that all oil sand slurried material passes over and through the screen cloths of the vibrating screen. This results in the rapid spalling and eventual wearing through of the screen cloths of the vibrating screen ("hole-throughs"), which can lead to production interruption and an unplanned maintenance event.

Thus, it is desirable to have an improved screen cloth that can withstand the abrasiveness of oil sand slurry.

SUMMARY OF THE INVENTION

It was discovered that screen cloths of vibrating and/or stationary screening devices used to screen frozen lumps, rocks and the like from oil sand slurry were wearing through much quicker than desired due to the abrasive nature of the slurry. In particular, it was discovered that the first few rows, referred to herein as the impact rows, of screen cloths of vibrating screening devices were suffering from localized wear phenomena resulting from the slurry flow distribution.

In one aspect of the present invention, an impact screen cloth for use in a screening device for screening out oversize objects in a material flowing in a direction is provided, comprising:

a metal plate having a perimeter and comprising a plurality of openings therethrough and forming a grid having longitudinal ligaments substantially parallel to the direction of the material flow and transverse ligaments substantially perpendicular to the direction of the material flow; and a number of longitudinal wear bars positioned on an equal number of longitudinal ligaments to cover a substantial portion of each longitudinal ligament without covering the openings.

In one embodiment, the height of the longitudinal wear bar is proportional to size of the openings to elevate the oversize objects that are larger than the size of the openings and thus prevent the oversize objects such as lumps and rocks from contacting the transverse ligaments. In one embodiment, impact screen cloths are used in vibrating screening devices and the height of the longitudinal wear bars are generally about 60% of the width of the openings or greater. In one embodiment, impact screen cloths are used in stationary or fixed screening devices and the height of the longitudinal bars are generally about 40% of the width of the openings or greater.

In one embodiment, the impact screen cloth further comprises a number of transverse wear bars positioned between the number of longitudinal wear bars. In another embodiment, the longitudinal wear bars are fabricated from mild steel with high wear material and are welded to the longitudinal ligaments of the perforated metal plate.

In one embodiment, wear materials for the longitudinal wear bars can be ceramics, chromium carbide, tungsten carbide or sintered tungsten carbide. These materials can be thermally (e.g., vulcanizing, welding, brazing, etc.), chemically (e.g., epoxy) or mechanically (e.g. bolted, dovetailed, etc.) attached to the wear bars.

In yet another embodiment, the perforated metal plate is made from structural steel (e.g., high tensile steel, stainless steel, carbon steel, etc.) and is overlayed with multi-pass layers of chromium carbide, tungsten carbide (PTA or Technoginia products) or cast wear products (e.g., ceramic, Kencast or sintered tungsten carbide tile) to increase its thickness. Thus, the increase in structural competence by the addition of longitudinal wear bars minimizes the spalling of the overlay on the metal plate.

In another aspect of the present invention, a screen for use in a vibrating or stationary screening device, the screen having a feed end and a discharge end, for screening oversize objects in a material is provided, comprising:

a number of screening rows positioned end to end between the feed end and the discharge end, each row having at least one screen cloth and each screen cloth comprising a metal plate having a perimeter and having a plurality of openings therethrough to form a grid having longitudinal ligaments substantially parallel to the direction of the material flow and transverse ligaments substantially perpendicular to the direction of the material flow;

whereby the at least one screen cloth of at least one screening row further comprises a number of longitudinal wear bars positioned on an equal number of longitudinal ligaments to cover a substantial portion of each longitudinal ligament without substantially interfering with the openings.

In one embodiment, the at least one screening row is the screening row closest to the feed end. Thus, the primary impact zone is reinforced by providing additional sacrificial material in the form of longitudinal wear bars.

In one embodiment, the screen for use in the vibrating or stationary screening device comprises at least two screening rows, each screening row having at least one screen cloth, wherein the at least one screen cloth of the screening row closest to the feed end has a greater number of longitudinal wear bars than the at least one screen cloth of the next screening row.

Other features will become apparent from the following detailed description. It should be understood, however, that the detailed description and the specific embodiments, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the following figures. It is understood that the drawings provided herein are for illustration purposes only and are not necessarily drawn to scale.

DESCRIPTION OF THE PREFERRED EMBODIMENT

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1A:
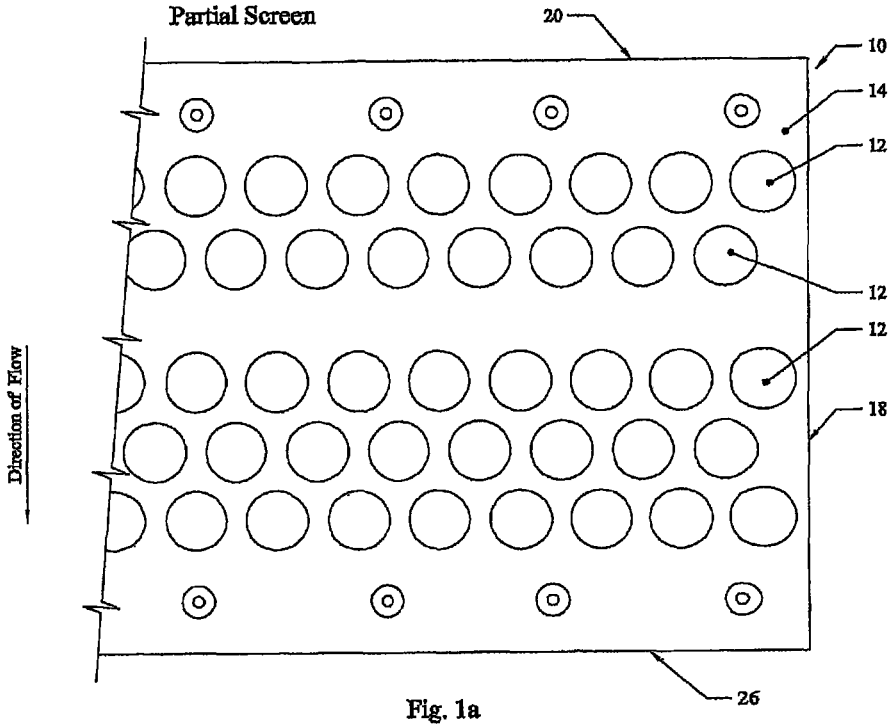
FIG. 1*a* is a top view of a screen cloth of the prior art.
Figure 1B:
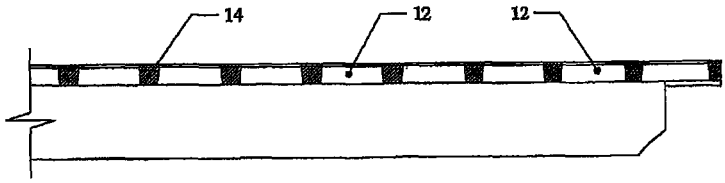
FIG. 1*b* is a cross-section of a screen cloth of the prior art.
Figure 1C:
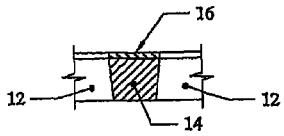
Fig. 1c PRIOR ART
FIG. 1*c* is an enlargement of a portion of the cross-sectional view of FIG. 1*b*.

Turning first to FIGS. 1*a*, 1*b* and 1*c* (Prior Art), screen cloth 10 (partial) is made from a perforated plate 14 having a side edge 18 (the opposite side edge is not shown), a bottom edge 26 and a top edge 20. Perforated plate 14 can be made of a number of different materials, preferably, structural steel. Openings 12 in perforated plate 14 are generally of a consistent size, wherein the size is dependent on the size of the oversize that one desires to screen out. In this embodiment, openings are round. Perforated plate 14 is constructed from a large piece of steel, which forms the perimeter of the screen cloth, and a regular pattern of openings or holes are cut and/or punched (flame, plasma) therethrough to form the mesh of the screen plate. It can further be seen from FIG. 1*a* that the direction of flow of material to be screened is from top edge 20 to bottom edge 26.

FIG. 1*b* is a cross-section of screen cloth 10 and FIG. 1*c* is an enlargement of a portion of screen cloth 10 shown in FIG. 1*b*. It can be seen from FIG. 1*c* that screen cloth 10 has an overlay 16 such as tungsten carbide. However, it was found that these prior art screens wore very quickly, despite overlay 16.

Figure 1D:
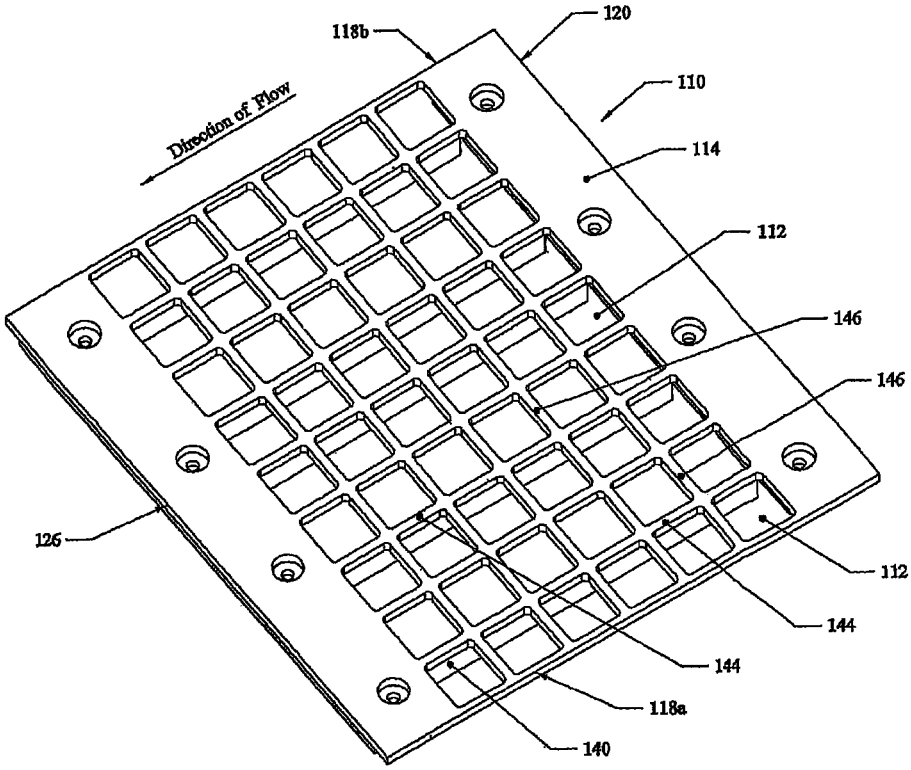
FIG. 1*d* is a perspective view of another screen cloth of the prior art.

FIG. 1*d* is a perspective view of another prior art screen cloth where additional supporting structures have been added to increase the strength of the screen cloth. In this embodiment screen cloth 110 is fabricated from a large steel plate 114 having a perimeter comprising sides 118*a* and 118*b*, top edge 120 and bottom edge 126. The direction of flow is from the top edge 120 to the bottom edge 126. A plurality of substantially square openings 112 are cut or punched (flame, plasma) on the plate 114 to form a mesh comprising longitudinal ligaments 144 and transverse ligaments 146.

It is understood that multiple of these screen cloths will be installed in a vibrating or stationary screening device's main cross members to form the screening deck (also referred to herein simply as the screen) of the vibrating or stationary screening device. Screen cloths can be attached to the main cross members by means of bolts inserted through bolt holes 150.

Figure 1E:
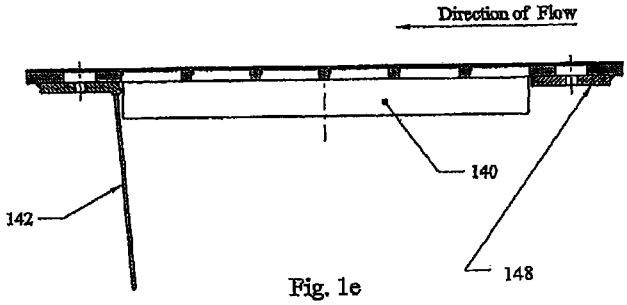
Fig. 1e PRIOR ART
FIG. 1*e* is the longitudinal section of the screen cloth of the prior art shown in FIG. 1*d*.

In the embodiment shown in FIG. 1*d*, multiple reinforcement gusset plates 140 are strategically welded under and along the entire length of the longitudinal ligaments 144 to increase the rigidity of screen cloth 110. This can be seen more clearly in FIG. 1*e*, which is the longitudinal section of the screen cloth in 1*d*. Bolting plate 148 provides further support when bolting the screen cloth 110 to the screening device. All top surfaces of screen cloth 110 can be protected from additional wear by either overlay products such as chromium carbide, tungsten carbide (PTA or Technoginia products) or cast wear products (ceramic, Kencast or sintered tungsten carbide tile). These products can be welded, bolted and/or brazed onto the screen cloth.

FIGS. 2*a* to 2*e* illustrate one embodiment of an impact screen cloth of the present invention. Impact screen cloth 210 comprises perforated plate 214 having a first side edge 218*a*, a second side edge 218*b*, a top edge 220 (material or feed end) and a bottom edge 226 (oversize exit end). Openings 212 in perforated plate 214 are rectangular in shape and the size of the openings is dependent on the size of the oversize that one desires to screen out. Generally, the openings are of a consistent size as well. As was the case with perforated plate 114 of FIG. 1*d*, perforated plate 214 may also be constructed from a large piece of steel, which forms the perimeter of the screen cloth 210, and the openings 212 are cut and/or punched (flame, plasma) therethrough to form the mesh of screen cloth 210 which also comprises longitudinal ligaments 244 and transverse ligaments 246.

Figure 2A:
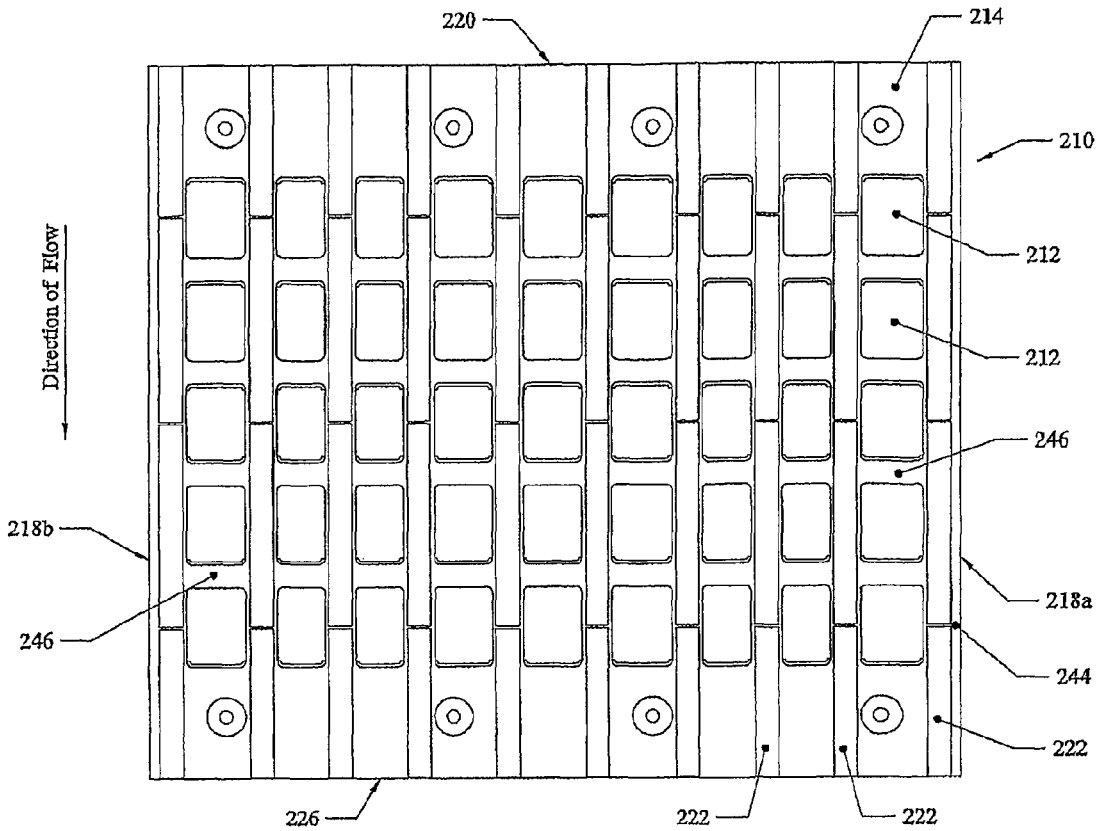
FIG. 2*a* is a top view of an embodiment of an impact screen cloth of the present invention.

In the embodiment shown in FIG. 2*a*, impact screen cloth 210 further comprises longitudinal wear bars 222, wherein each longitudinal wear bar 222 extends essentially from the top edge 220 to the bottom edge 226 of perforated plate 214 and covers a substantial portion of the longitudinal ligaments 244. In FIG. 2*a*, the longitudinal wear bars 222 are formed using four separate bar segments to minimize distortion of the perforated plate 214, however, it is understood that the longitudinal wear bars can also be a single structure. Further, longitudinal wear bars 222 are transversely spaced so that they do not substantially interfere with the size of the openings 212 and generally a longitudinal wear bar 222 is positioned directly adjacent both the first side edge 218*a* and the second side edge 218*b*.

Figure 2B:
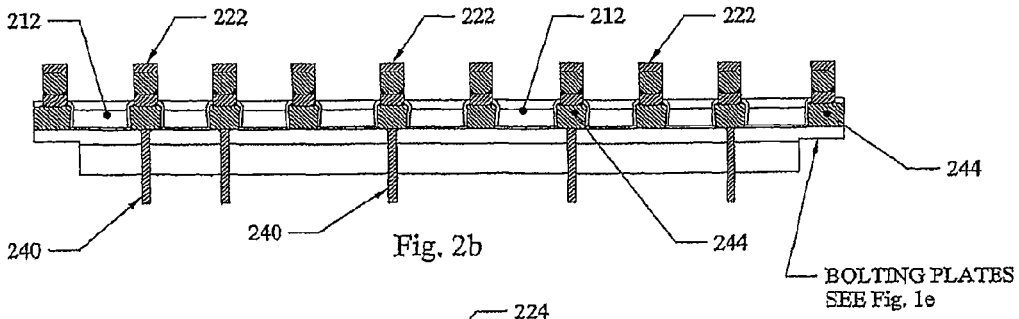
FIG. 2*b* is a cross-section of the impact screen cloth embodiment shown in FIG. 2*a*.
Figure 2C:
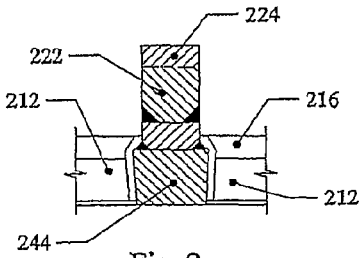
FIG. 2*c* is an enlargement of a portion of the cross-sectional view of FIG. 2*b*.
Figure 2D:
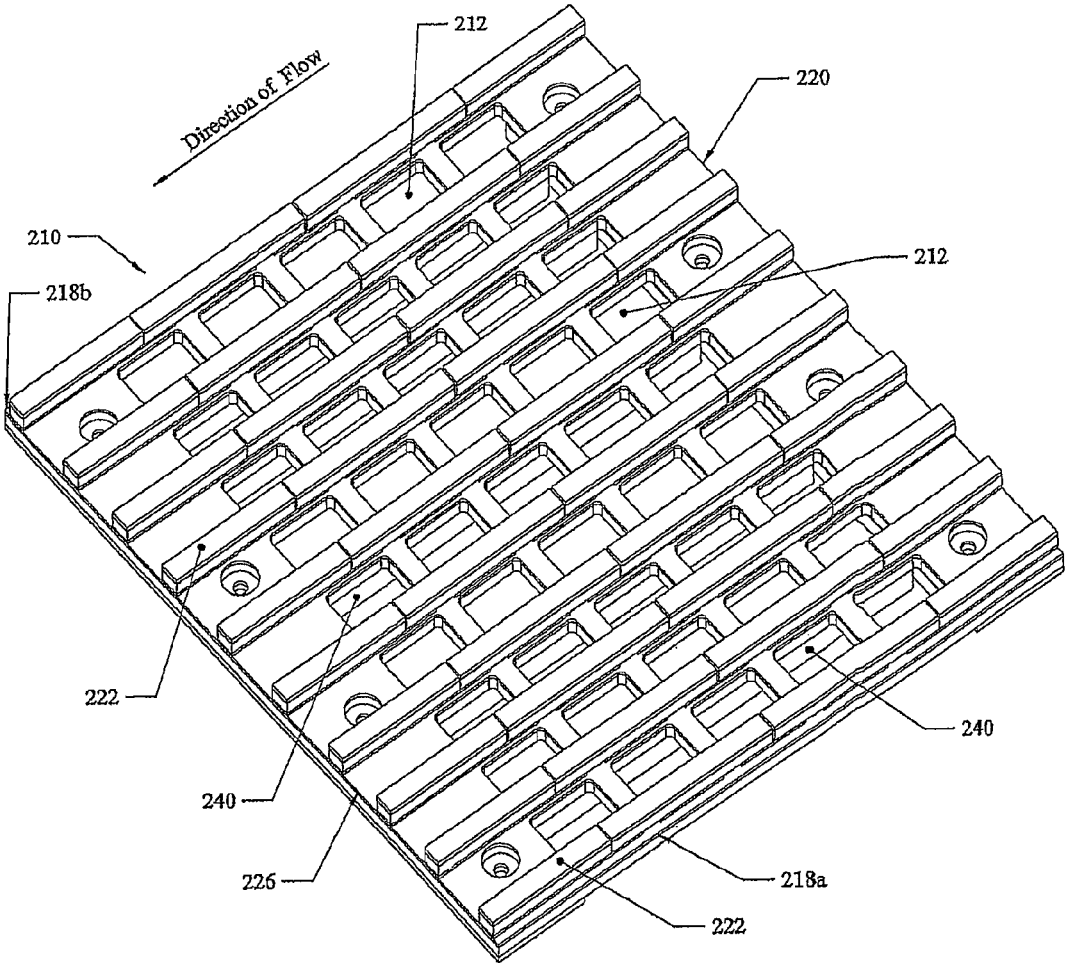
FIG. 2*d* is a perspective view of the impact screen cloth shown in FIG. 2*a*.

FIG. 2*b* is a cross-section of screen cloth 210 and FIG. 2*c* is an enlargement of a portion of impact screen cloth 210 shown in FIG. 2*b*. It can be seen from FIGS. 2*b* and 2*c* that longitudinal wear bars 222 are raised and the height of each longitudinal wear bar 222 is proportional to size of the openings 212 (e.g., in this embodiment, the height of the longitudinal wear bars is about $^{3}/_{5}{}^{th}$ the width of the openings 212). In addition to the longitudinal wear bars 222, it can be seen in FIG. 2*c* that perforated plate 214 may be coated with multi-pass layers of tungsten carbide 216 to increase its thickness as compared to prior art screen cloth shown in FIG. 1*c*. Thus, the increase in structural competence by the addition of longitudinal wear bars minimizes the spalling of the thicker tungsten carbide layer. Further wear material 224 can be provided for the longitudinal wear bars as well, for example, ceramic carbide (e.g., tungsten carbide) or brazed-on high wear material (e.g., chrome white iron material).

As was the case in the embodiment shown in FIG. 1*d*, and which can be seen more clearly in longitudinal section 2*e* and perspective view 2*d*, multiple reinforcement gusset plates 240 may be strategically welded under and along the entire length of the longitudinal ligaments 244 to increase the rigidity of screen cloth 210. In addition, transverse stiffeners 246 also provide additional support. Bolting plates 248 aid in the secure fastening of the screen cloth 210 to the screening device by means of bolts inserted through bolt holes 250.

It is understood that longitudinal wear bars can be fixed to the perforated plate 214 by any means known in the art, for example, welding the bars thereon. In one embodiment, impact screen cloth 210 of the present invention comprises a frame having first side edge 218*a*, second side edge 218*b*, top edge 220 and bottom edge 226) which supports a plurality of longitudinal ligaments 244 and a plurality of transverse ligaments 246 which ligaments intersect to form a mesh or grid. The openings 222 formed between the longitudinal ligaments 244 and transverse ligaments are generally uniform in size. The longitudinal ligaments extend essentially from the feed end to the oversize exit end and the transverse ligaments extend essentially from the first side edge to the second side edge. The longitudinal ligaments are raised relative to the transverse ligaments as a result of the attached longitudinal wear bars 222.

Figure 2E:
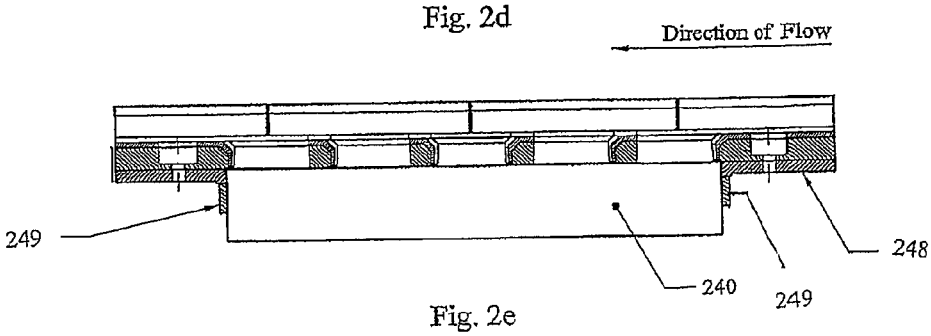
FIG. 2*e* is the longitudinal section of the impact screen cloth shown in FIG. 2*d*.

FIG. 2*e* show bolting plates 248 which provides further support when bolting the screen cloth 210 to the screening device. Optionally, the screen cloth 210 may further comprise transverse stiffeners 249.

Figure 3:
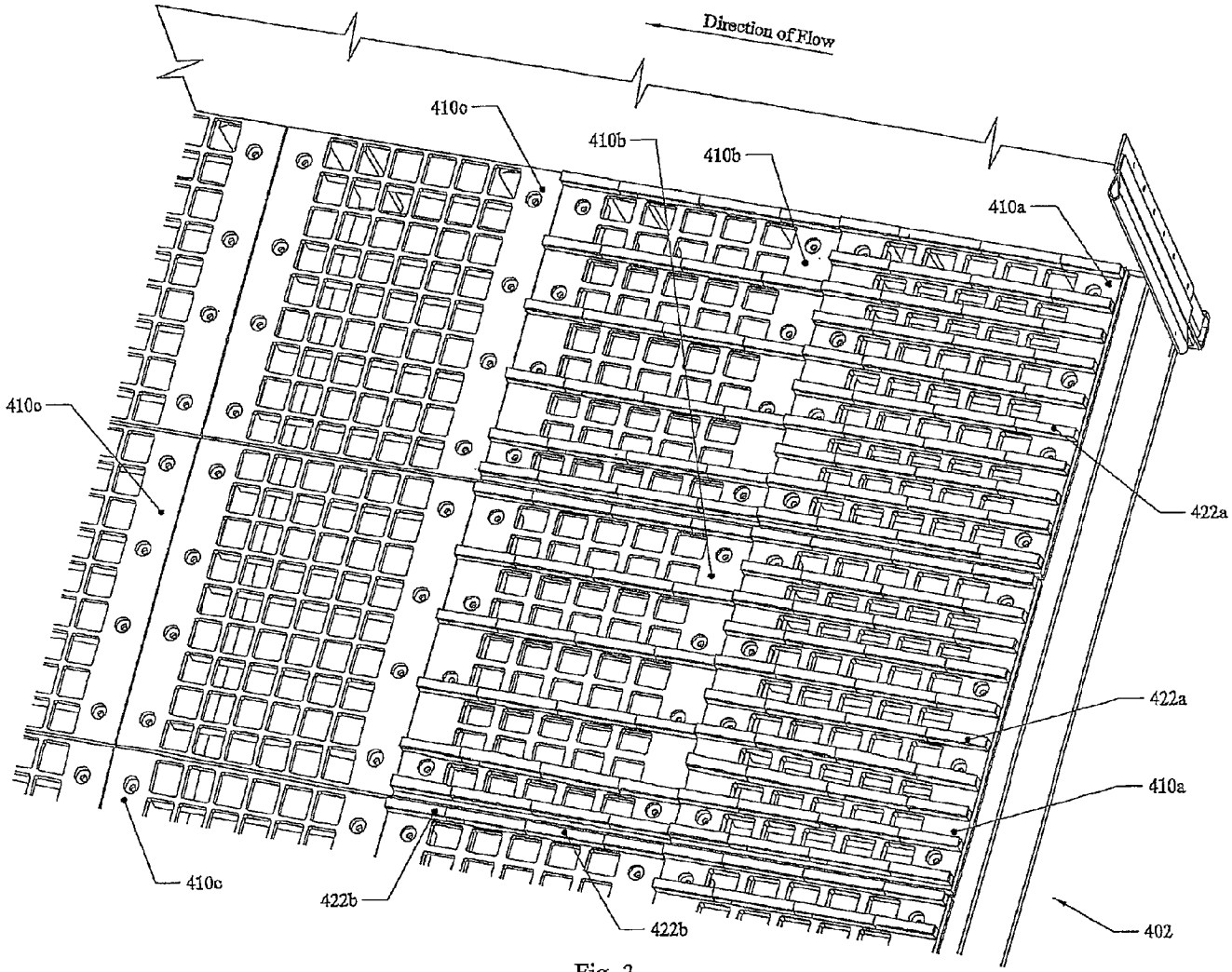
FIG. 3 is a top view of a screen useful in a vibrating screening device comprising a plurality of impact screen cloths of the present invention.

FIG. 3 is a top view of a portion of a screen 402 useful in a vibrating screening device. As can be seen in FIG. 3, screen 402 comprises a plurality of individual screen cloths of three different kinds, namely, 410*a*, 410*b* and 410*c*. Screen cloths 410*a* form the first row of screen cloths (Row 1), screen cloths 410*b* form the second row of screen cloths (Row 2), and screen cloths 410*c* form the third row of screen cloths (Row 3). The feed (e.g., oil sand slurry to be screened) is initially deposited on Row 1 and then travels the entire length of the screen 402 in the direction of flow as shown in FIG. 3. Thus, the screen cloths which will receive the greatest wear would be screen cloths 410*a*. Thus, screen cloths 410*a* are reinforced with longitudinal wear bars, 422*a*, positioned on each longitudinal ligament 444*a*. Screen cloths 410*b* will have less wear than screen cloths 410*a* and even though screen cloths 410*b* are reinforced with longitudinal wear bars 422*b*, only every other longitudinal ligament 444*b* is reinforced. Screen cloths 410*c* (and subsequent screen cloths) do not have any longitudinal wear bars.

The use of longitudinal wear bars on the first two rows of screen cloths increased the life of the screens from about 500 hours to about 2000 hours. Even more importantly, however, is that such an arrangement of more reinforcement in Row 1, less in Row 2, and none in subsequent rows, results in uniform wear across all screen cloths of the screen 402. This optimizes the run time of the vibrating screen device so that the operator does not have to shut the device down multiple times to change screen cloths.

Figure 4:
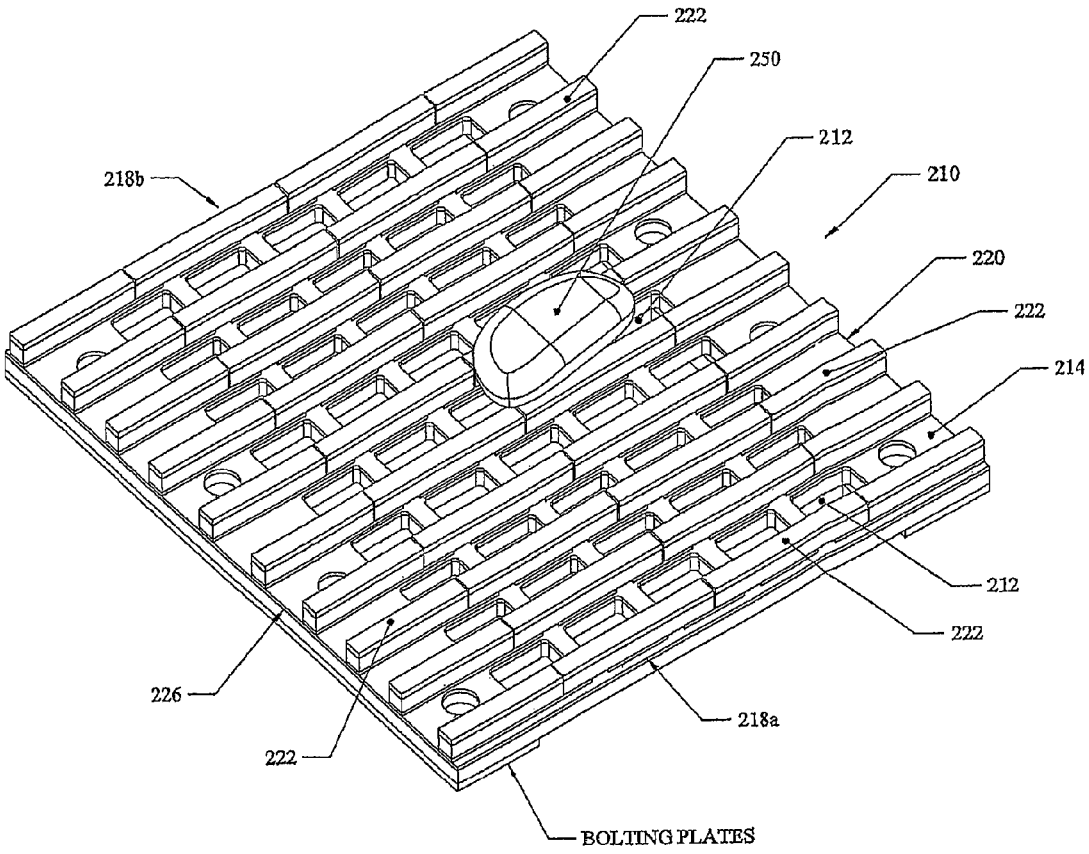
FIG. 4 is a perspective view of the impact screen cloth shown in FIG. 2*a* in operation.

FIG. 4 is a perspective view of the impact screen cloth 210 shown in FIGS. 2*a*-2*e* in operation. As it can be seen in FIG. 4, longitudinal wear bars 222 prevent rock 250 from impacting on the screen cloth perforated plate 214. Further, in this embodiment, the longitudinal wear bars are spaced fairly close together, which allows rock 250 to essentially ride on top of the longitudinal wear bars 222 in the direction of flow.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

We claim:

1. An impact screen cloth for use in a screening device for screening out oversize objects in a material flowing in a direction, comprising:

a metal plate having a perimeter and comprising a plurality of openings therethrough and forming a grid having longitudinal ligaments substantially parallel to the direction of the material flow and transverse ligaments substantially perpendicular to the direction of the material flow; and a number of longitudinal wear bars positioned on an equal number of longitudinal ligaments to cover a substantial portion of the number of longitudinal ligaments without substantially interfering with the openings;

wherein the metal plate is made from structural steel and is protected with an overlay product including chromium carbide and tungsten carbide or a cast wear product including ceramic and sintered tungsten carbide tiles.

2. The screen cloth as claimed in claim 1 whereby the height of each longitudinal wear bar is proportional to size of the openings.

3. The screen cloth as claimed in claim 1 further comprising a number of transverse wear bars positioned on an equal number of transverse ligaments of the screen cloth.

4. The screen cloth as claimed in claim 1 wherein the longitudinal wear bars are fabricated from mild steel with high wear material and are welded to the longitudinal ligaments.

5. The screen cloth as claimed in claim 1 wherein the longitudinal wear bars are protected with a wear material.

6. The screen cloth as claimed in claim 5 wherein the wear material is a ceramic, chromium carbide, tungsten carbide, sintered tungsten carbide tiles or chrome white iron material.

7. The screen cloth as claimed in claim 1 wherein the metal plate is made from structural steel and is protected with multi-pass layers of tungsten carbide.

8. A screen for use in a vibrating or stationary screening device, the screen having a feed end and a discharge end, for screening oversize objects in a material is provided, comprising:

a plurality of screening rows positioned end to end between the feed end and the discharge end, each screening row comprising at least one screen cloth comprising a metal plate made from structural steel and protected with an overlay product including chromium carbide and tungsten carbide or a cast wear product including ceramic and sintered tungsten carbide tiles, the metal plate having a perimeter and having a plurality of openings therethrough to form a grid having longitudinal ligaments substantially parallel to the direction of the material flow and transverse ligaments substantially perpendicular to the direction of the material flow;

whereby at least one of the screening rows further comprises a number of longitudinal wear bars positioned on an equal number of longitudinal ligaments of each screen cloth in the screening row.

9. The screen as claimed in claim 8, wherein the at least one screening row is the screening row closest to the feed end.

10. The screen as claimed in claim 8, wherein the screen comprises at least two screening rows, wherein the screening row closest to the feed end has a greater number of longitudinal wear bars than the next screening row.

11. An impact screen cloth for use in a screening device for screening out oversize objects in a material flowing in a direction, comprising:

a frame having a first and second side edge, a top edge and a bottom edge;

a plurality of transverse ligaments extending from the first side edge to the second side edge;

a plurality of longitudinal ligaments extending from the top edge to the bottom edge and intersecting the longitudinal ligaments to form a mesh having a plurality of essentially equal sized openings; and a number of longitudinal wear bars positioned on an equal number of longitudinal ligaments to cover a substantial portion of the number of longitudinal ligaments without substantially interfering with the openings;

wherein the frame, longitudinal ligaments and transverse ligaments are each made from structural steel and are protected with an overlay product including chromium carbide and tungsten carbide or a cast wear product including ceramic and sintered tungsten carbide tiles and whereby the material flows from the top edge to the bottom edge of the screen cloth.

12. The screen cloth as claimed in claim 11 whereby the height of each longitudinal wear bar is proportional to size of the openings.

13. The screen cloth as claimed in claim 11 further comprising a number of transverse wear bars positioned on an equal number of transverse ligaments of the screen cloth, whereby the height of the longitudinal wear bars is greater than the height of the transverse wear bars.

14. The screen cloth as claimed in claim 11 wherein the longitudinal wear bars are fabricated from mild steel with high wear material and are welded to the longitudinal ligaments.

15. The screen cloth as claimed in claim 11 wherein the longitudinal wear bars are protected with a wear material.

16. The screen cloth as claimed in claim 15 wherein the wear material is a ceramic, chromium carbide, tungsten carbide, sintered tungsten carbide tiles or chrome white iron material.

17. The screen cloth as claimed in claim 11 wherein the frame, longitudinal ligaments and transverse ligaments are each made from structural steel and are protected with multi-pass layers of tungsten carbide.

18. An impact screen cloth for use in a screening device for screening out oversize objects in a material flowing in a direction, comprising:

a frame having a first and second side edge, a top edge and a bottom edge;

a plurality of transverse ligaments extending from the first side edge to the second side edge; and a plurality of longitudinal ligaments extending from the top edge to the bottom edge and intersecting the longitudinal ligaments to form a mesh having a plurality of essentially equal sized openings;

wherein the frame, longitudinal ligaments and transverse ligaments are each made from structural steel and are protected with an overlay product including chromium carbide and tungsten carbide or a cast wear product including ceramic and sintered tungsten carbide tiles and whereby at least one of the longitudinal ligaments has a height greater than the transverse ligaments and the material flows from the top edge to the bottom edge of the screen cloth.

19. The screen cloth as claimed in claim 18 wherein the frame, longitudinal ligaments and transverse ligaments are each made from structural steel and are protected with multi-pass layers of tungsten carbide.

20. An impact screen cloth for use in a screening device for screening out oversize objects in a material flowing in a direction, comprising:

a metal plate having a perimeter and comprising a plurality of openings therethrough and forming a grid having longitudinal ligaments substantially parallel to the direction of the material flow and transverse ligaments substantially perpendicular to the direction of the material flow;

a number of longitudinal wear bars positioned on an equal number of longitudinal ligaments to cover a substantial portion of the number of longitudinal ligaments without substantially interfering with the openings; and a number of transverse wear bars positioned on an equal number of transverse ligaments to cover a substantial portion of the number of transverse ligaments without substantially interfering with the openings.

21. The screen cloth as claimed in claim 20 wherein the longitudinal wear bars are protected with a wear material.

22. The screen cloth as claimed in claim 21 wherein the wear material is a ceramic, chromium carbide, tungsten carbide, sintered tungsten carbide tiles or chrome white iron material.

23. The screen cloth as claimed in claim 20 wherein the metal plate is made from structural steel and is protected with an overlay product including chromium carbide and tungsten carbide or a cast wear product including ceramic and sintered tungsten carbide tiles.

24. An impact screen cloth for use in a screening device for screening out oversize objects in a material flowing in a direction, comprising:

a frame having a first and second side edge, a top edge and a bottom edge;

a plurality of transverse ligaments extending from the first side edge to the second side edge;

a plurality of longitudinal ligaments extending from the top edge to the bottom edge and intersecting the longitudinal ligaments to form a mesh having a plurality of essentially equal sized openings;

a number of longitudinal wear bars positioned on an equal number of longitudinal ligaments to cover a substantial portion of the number of longitudinal ligaments without substantially interfering with the openings; and a number of transverse wear bars positioned on an equal number of transverse ligaments to cover a substantial portion of the number of transverse ligaments without substantially interfering with the openings;

whereby the height of the longitudinal wear bars is greater than the height of the transverse wear bars.

25. The screen cloth as claimed in claim 24 wherein the longitudinal wear bars are protected with a wear material.

26. The screen cloth as claimed in claim 25 wherein the wear material is a ceramic, chromium carbide, tungsten carbide, sintered tungsten carbide tiles or chrome white iron material.

27. The screen cloth as claimed in claim 24 wherein the screen cloth is protected with an overlay product including chromium carbide and tungsten carbide or a cast wear product including ceramic and sintered tungsten carbide tiles.

* * * * *